US006209246B1

(12) United States Patent
Schwartz

(10) Patent No.: US 6,209,246 B1
(45) Date of Patent: Apr. 3, 2001

(54) CARD ASSEMBLY FOR USE WITH A COMPUTER DISPLAY DEVICE

(75) Inventor: Russell J. Schwartz, Sonoma, CA (US)

(73) Assignee: Left Coast Interactive, Mill Valley, CA (US)

( * ) Notice: Subject to any disclaimer, the term of this patent is extended or adjusted under 35 U.S.C. 154(b) by 0 days.

(21) Appl. No.: 09/170,175

(22) Filed: Oct. 13, 1998

Related U.S. Application Data

(63) Continuation of application No. 08/539,325, filed on Oct. 4, 1995, now Pat. No. 5,819,456.

(51) Int. Cl.[7] ..... G09F 3/18

(52) U.S. Cl. ..... 40/642; 40/658; 40/404; 40/377

(58) Field of Search ..... 40/642, 658, 404, 40/377; 248/918, 451

(56) References Cited

U.S. PATENT DOCUMENTS

| | | | | |
|---|---|---|---|---|
| 3,368,296 | * | 2/1968 | Edwards | 40/336 |
| 4,693,443 | * | 9/1987 | Drain | 248/918 X |
| 5,078,358 | * | 1/1992 | Egly et al. | 248/918 X |
| 5,505,421 | * | 4/1996 | Marthaler | 248/918 X |
| 5,672,105 | * | 9/1997 | Curic | 248/918 X |

* cited by examiner

*Primary Examiner*—Joanne Silbermann
(74) *Attorney, Agent, or Firm*—Henricks, Slavin & Holmes LLP

(57) ABSTRACT

A card assembly for use with a computer display device. The card assembly includes at least one card and a card holder for holding the card. In addition, the card assembly also includes a mounting unit that is connected to the card holder. This mounting unit rigidly and detachably affixes the card holder to the computer display device.

13 Claims, 3 Drawing Sheets

CARD ASSEMBLY FOR USE WITH A COMPUTER DISPLAY DEVICE

This application is a Continuation of U.S. patent application Ser. No. 08/539,325, filed Oct. 4, 1995 issued as U.S. Pat. No. 5,819,456 on Oct. 13, 1998.

The present invention is directed towards a card assembly for use with a computer display device.

BACKGROUND OF THE INVENTION

Often, computer users place utilitarian objects in their field of view near the display screen. Some examples of these useful items include handwritten notes and manufacturer supplied instruction guides that set forth software commands. In addition, as computer users spend countless hours facing their display screens, they often surround their display screens with decorative items that enhance the aesthetic quality of their environment.

Furthermore, in the prior art there exists several devices that allow utilitarian or decorative items to be attached to the computer display device. For example, U.S. Pat. No. 5,104,087 discloses a note/memo board that surrounds a computer display device on three sides. This board attaches to the display housing with angled brackets backed with VELCRO™ material that mate with VELCRO™ material strips on the sides and top of the display. Unfortunately, however, this note/memo board is out of the field of the user's focus as it mounts to the display device behind the plane of the display screen. Moreover, the amount of utilitarian or decorative items that can be attached to, or written on, this board is confined to the limited surface area of this board.

Under another prior art approach, a frame (such as the screen frame sold under the brand name Screenies) is detachably affixed to more than one side of a display screen. The computer user can then use this frame for utilitarian or decorative purposes. Unfortunately, the limited surface area of this prior art device also provides a limited amount of space for attaching or writing utilitarian or decorative items. Consequently, there is a need in the art for an apparatus that enables a computer user to position a maximum amount of utilitarian and decorative items in her field of view near the display screen.

SUMMARY OF THE INVENTION

The present invention provides a card assembly for use with a computer display device. The card assembly includes at least one card and a card holder for holding the card. In addition, the card assembly also includes a mounting unit that connects to the card holder. This mounting unit attaches the card holder to the computer display device.

DETAILED DESCRIPTION OF THE INVENTION

The invention is a card assembly for use with a computer display device. In the following description, numerous details are set forth for purpose of explanation. However, one of ordinary skill in the art would realize that the invention may be practiced without the use of these specific details.

One embodiment of the invention's card assembly includes at least one card and a card holder for holding the card. The card assembly also includes a mounting unit that connects to the card holder. This mounting unit affixes the card holder to a computer display device. For example, some embodiments of the mounting unit (such as the embodiment set forth in FIGS. 2 and 3) indirectly couple to a display device, by coupling to a rigid mating surface (such as a screen frame sold under the brand name Screenies) which attaches to one or more sides of the display device. On the other hand, alternative embodiments of the mounting unit (such as the embodiment set forth in FIG. 7) directly couple to the display device. Still other embodiments of the mounting unit (such as the embodiment set forth in FIG. 8) attach either (1) directly to the display bezel, or (2) indirectly to the display bezel through a rigid mating surface affixed to one or more side of the display bezel.

Figure 1:
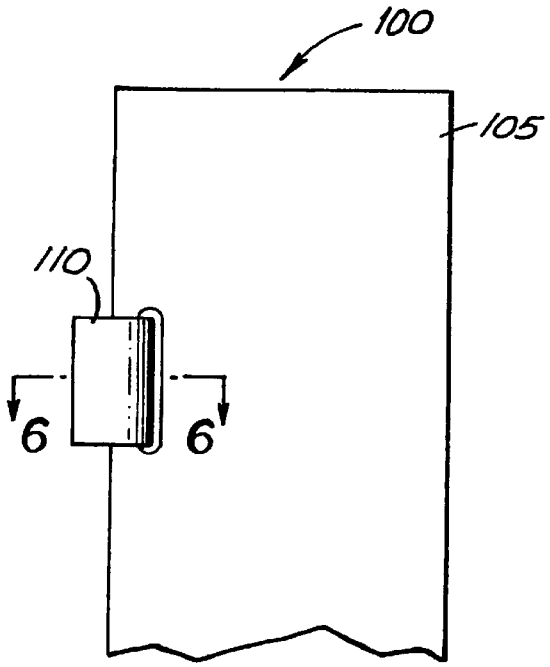
FIG. 1 presents a frontal view of one embodiment of the card assembly of the invention.
Figure 2:
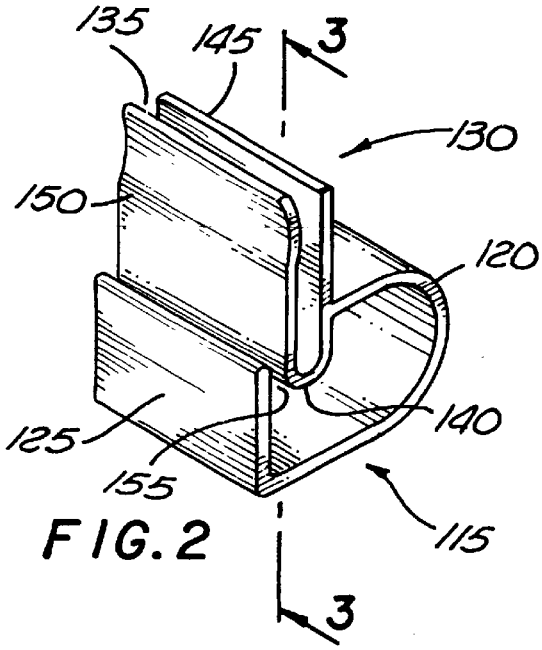
FIG. 2 presents a perspective view of one embodiment of a card holder and a mounting unit of the card assembly of FIG. 1.
Figure 3:
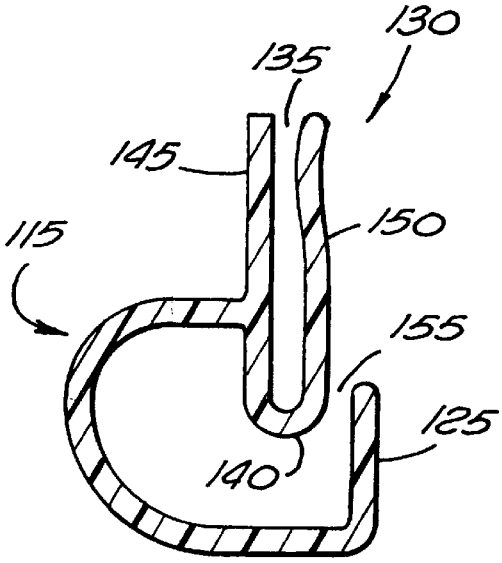
FIG. 3 presents a cross-sectional view of the card holder and mounting unit of FIG. 2.

FIG. 1 sets forth a frontal view of one embodiment of the invention's card assembly. As shown in this figure, card assembly 100 includes at least one card (105) and at least one card holding unit (110). Card holding unit 110 can have a variety of embodiments. FIGS. 2 and 3 set forth one embodiment of card holding unit 110. As shown in these figures, card holding unit 110 includes card holder 115 for holding cards and mounting unit 130 for attaching the card holder to the display device.

Figure 4:
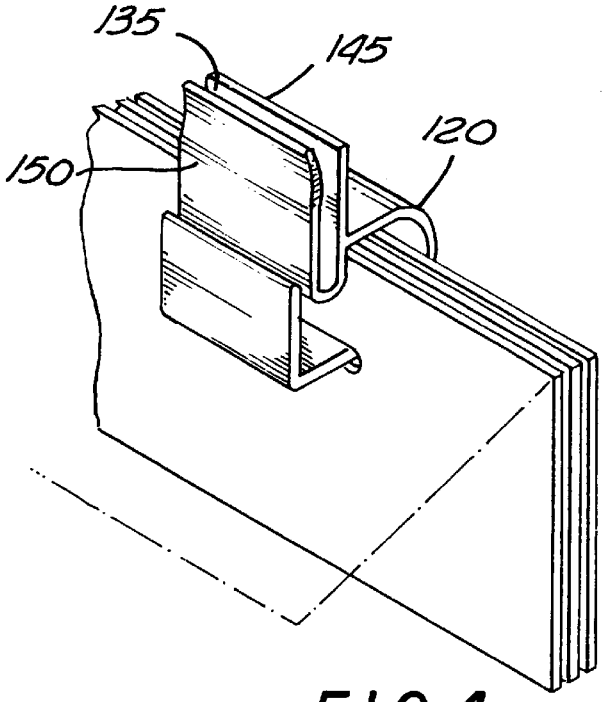
FIG. 4 presents a perspective view of the card assembly of FIG. 1.

Card holder 115 includes semi-ring portion 120, which holds a card for viewing and allows the user to turn the card to view its back side or a card that is positioned behind it. Card holder 115 also includes lip 125, which (as shown in FIG. 4) passes through a hole in a card to enable the card to be inserted into the card holder's semi-ring portion. Lip 125 is a straight lip that extends from the semi-ring portion at ninety degrees. One of ordinary skill in the art would realize that, in alternative embodiments of the invention, lip 125 is not straight (as discussed below with respect to FIG. 6) and/or does not extend from the semi-ring portion at a ninety degree angle.

Figure 5:
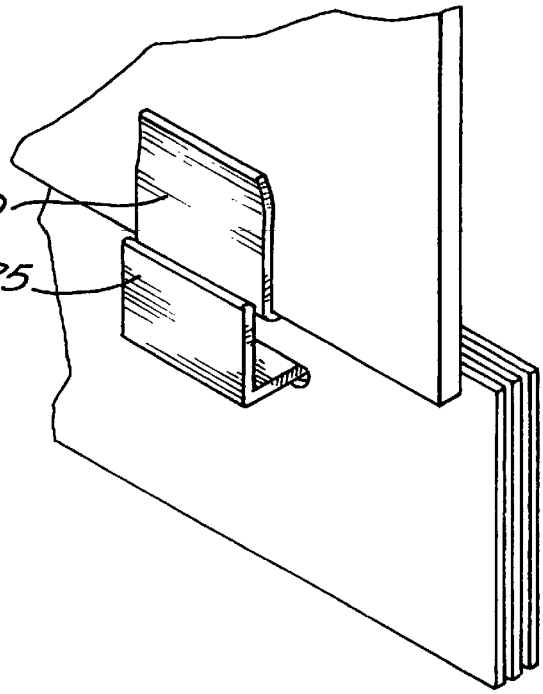
FIG. 5 presents a perspective view of the mounting unit rigidly and detachably attaching the card assembly of FIG. 1 to a screen frame.

As mentioned before, card holding unit 110 also includes mounting unit 130 which, in the embodiment set forth in FIGS. 2 and 3, is a clamping jaw that rigidly and detachably affixes the card holder to a rigid mating surface (such as a screen frame) affixed to one or more sides of the display device. Clamping jaw 130 has an open end 135 and a closed end 140. The clamping jaw further has planar body 145 and curved body 150, which couple to each other at the closed end of the clamping jaw. In addition, towards the open end of the clamping jaw, surface 150 slightly bends towards surface 145, in order to rigidly (and yet detachably) engage the screen frame that is inserted through the open end of the clamping jaw. In other words, the inside surfaces of planar body 145 and curved body 150 define a camming surface that resiliently (1) bends away from curved body 145, when a screen framed is inserted into the clamping jaw, and then (2) bends back to rigidly hold onto the frame. This rigid and detachable engagement is shown in FIG. 5. Finally, lip 125 of card holder 115 and the back side of curved body 150 define an aperture 155 for allowing the cards to be inserted into card holder 115 through lip 125.

Figure 6:
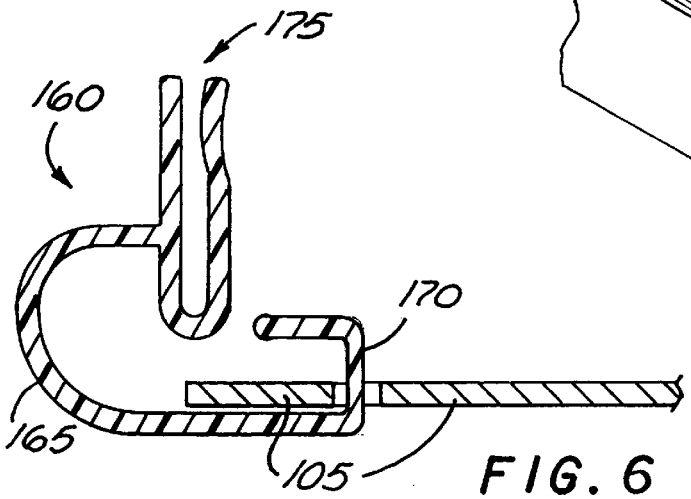
FIG. 6 presents a cross-sectional view of another embodiment of the card holder of the card assembly of FIG. 1.

Numerous alternative embodiments of card holder 115 and mounting unit 130 exist. For instance, FIG. 6 presents a cross-sectional view of another embodiment of the card holder. Card holder 160 is identical to card holder 115 in that it includes a semi-ring portion (165) and a lip (170) and it connects to a clamping jaw (175), except that it has an "L" shaped lip as opposed to a straight lip. Even though this shape of lip 170 makes inserting a card into semi-ring portion 165 more difficult than when a straight lip is utilized, the use of this "L" shaped lip is advantageous in that this shape also makes it more difficult for a card to eject accidentally from the card holder.

Furthermore, an alternative embodiment of card holder 115 utilizes a lip that has a blocking-end affixed to it (e.g., a ball-end threadedly affixed to it) after the cards have been inserted into the semi-ring portion. Yet another embodiment of card holder 115 does not have a lip but rather utilizes an injection molded hinge clip that (1) at one end affixes to the semi-ring portion, and (2) at the other end detachably affixes either to the computer bezel or to the mounting unit. Still another embodiment of card holder 115 does not include a semi-ring portion and a lip, but rather simply includes an enclosed ring portion; the cards are inserted into this ring portion prior to its enclosure.

Figure 7:
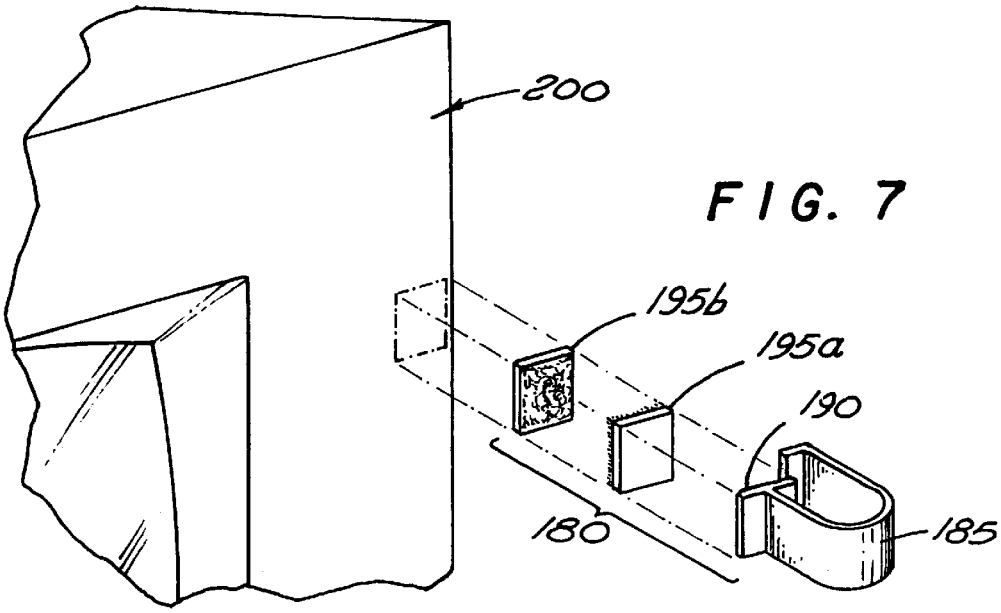
FIG. 7 presents another embodiment of the mounting unit.

FIG. 7 presents another embodiment of the mounting unit. As shown in this figure, mounting unit 180 directly affixes card holder 185 (which is similar to card holder 115 of FIG. 2) to the housing of a computer display device. In other words, this mounting unit replaces the clamping jaw and provides a mechanical connection between card holder 185 and display screen housing 200. This mounting unit includes planar body 190 and hook and loop fasteners 195 (such as VELCRO™ strips). Planar body 190 connects on its front side to card holder 185 and connects on its rear side to fastener 195*a*. One embodiment of fastener 195*a* adhesively attaches to the rear surface of planar body 190. Fastener 195*a* then attaches to corresponding fastener 195*b* which, in one embodiment, adhesively attaches to the display bezel 200. The use of hook and loop fasteners 195 permits one card holder to be easily replaced by another.

Figure 8:
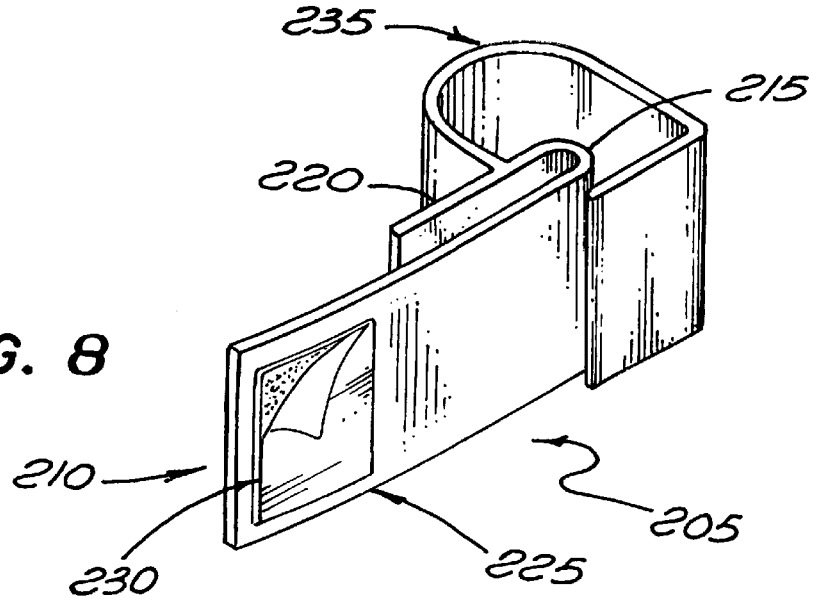
FIG. 8 presents yet another embodiment of the mounting unit.

FIG. 8 presents yet another embodiment of the mounting unit. This embodiment of the mounting unit can attach its card holder either (1) directly to the display bezel, or (2) indirectly to the display bezel through a rigid mating surface (e.g., a screen frame) affixed to one or more side of the display bezel. More specifically, mounting unit 205 is a clamping jaw with an open end 210, a close end 215, planar body 220, and curved body 225. The curved body connects to planar body 220 at closed end 215, and slightly bends body 220 towards open end 210.

In addition, mounting unit 205 also has adhesive strip 230 attached to the back side of curved body 225. Adhesive strip 230 has a plastic strip covering it when it is not being used. By removing the plastic strip covering the adhesive strip, and by pressing the uncovered adhesive strip against the display bezel, card holder 235 directly couples to the display bezel. However, if a rigid mating surface (such as a screen frame) is already attached to one or more sides of the display device, mounting unit 205 can indirectly couple card holder 235 to the display device by causing its two bodies 220 and 225 to clamp the rigid mating surface. Thus, mounting unit 205 can couple the card holder to the display bezel either directly and permanently or indirectly and detachably. Finally, alternative embodiments of the mounting units permanently attach a card holder to the display housing through the use of screws or the like.

Figure 9:
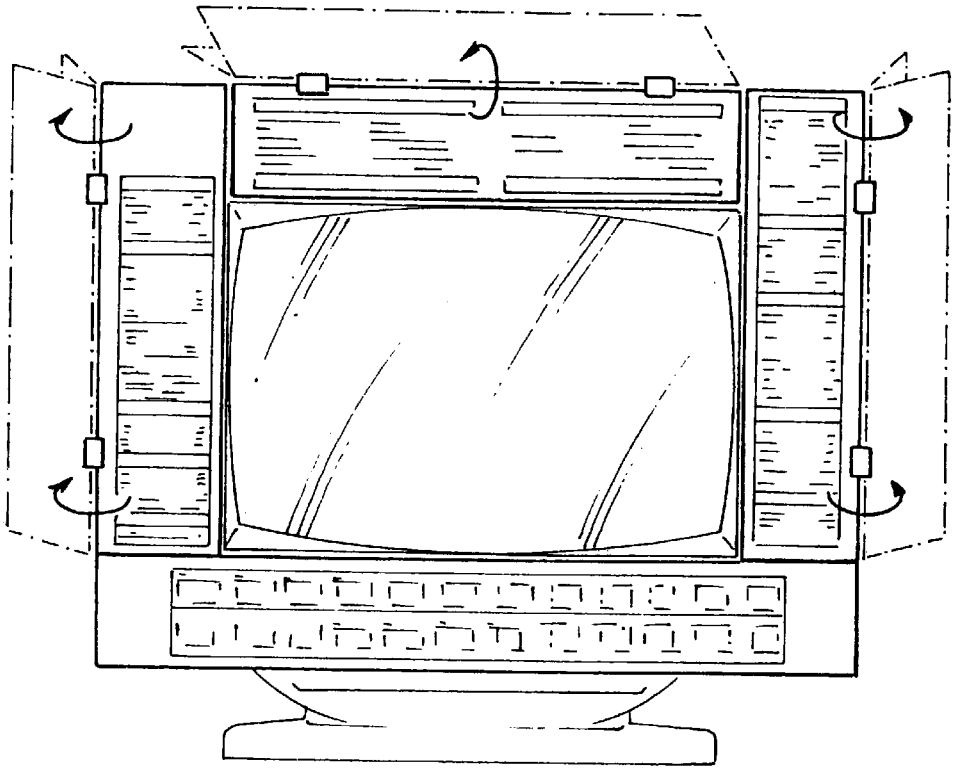
FIG. 9 sets forth one manner of utilizing one embodiment of the invention's card assembly.

FIG. 9 sets forth one manner of utilizing one embodiment of the present invention's card assembly. As shown in this figure, three individual card assemblies of the invention can be affixed to three sides of a display screen. Each of these card assemblies includes several cards, which are held by two card holding units affixed directly or indirectly to the display screen.

As apparent from the discussion above, the present invention is advantageous because it maximizes the amount of utilitarian and decorative items that a user can place in her field of view near the display screen, by allowing the user to position a large number of cards around the display screen. For example, by utilizing the invention to post numerous reference cards next to the display screen, a user can have a large amount of software short cuts, commands, and tips instantly available at her workstation without taking up any valuable desk space or computer memory.

In this manner, a user can instantly access answers to frequently asked questions and thereby increase her knowledge and proficiency. Moreover, the invention provides a natural, user-friendly way to integrate new knowledge while working. Alternatively, by using the invention to post numerous decorative cards next to the display screen, a computer user can create various decorative configurations to enhance the aesthetic quality of her working environment.

While the invention has been described with reference to numerous specific details, one of ordinary skill in the art would recognize that the invention can be embodied in other specific forms without departing from the spirit of the invention. Thus, one of ordinary skill in the art would understand that the invention is not to be limited by the foregoing illustrative details, but rather is to be defined by the appended claims.

I claim:

1. A system comprising:

a computer display device having a screen;

first and second mounting apparatuses each having a planar base, a semi-ring card-holding member formed as a curved band having a free end and a fixed end with said fixed end mounted to said planar base, and a surface-mounting element mounting said planar base to a surface of said computer display device; and a plurality of cards having indicia printed thereon, said cards having elongated mounting apertures for mounting over the curved bands of the card-holding member, wherein said plurality of cards are detachably mounted in tandem to said apparatuses with the mounted cards being rotatable between a first position wherein said cards lie parallel with a front surface of said display with said cards not obscuring any significant portion of said screen and with at least a portion of said printed indicia facing outwardly for viewing and a second position wherein said cards do not lie parallel with said front surface but extend away from said front surface also not obscuring any significant portion of the screen.

2. The apparatus of claim 1 wherein, for both said first and second apparatuses, said fixed end of semi-ring card-holding member is mounted perpendicular to said planar base and wherein said free end of said semi-ring card-holding member terminates in a flat end portion.

3. The system of claim 1 wherein, for both said first and second apparatuses, an outermost end of said free end of said semi-ring card-holding member is offset from an inner end of said planar base leaving a linear slot there between for passage of an outer edge portion of the card as said free end is passed through a respective said elongated aperture of the card.

4. The system of claim 1 wherein, for both said first and second apparatuses, said free end of said semi-ring card-holding member extends partially past an outer end of said planar base.

5. The system of claim 1 wherein, for both said first and second apparatuses, said surface mounting element is an adhesive strip.

6. The system of claim 1 wherein said free end is positioned in spaced relation to said planar base thereby forming an opening there-between and with said semi-ring card-holding member being sufficiently rigid so that the free end remains off-set from said planar base while in use such that said semi-ring card-holding member remains open while in use.

7. A system comprising:

a computer display device;

first and second mounting apparatuses each having a planar base, a semi-ring card-holding member having a free end and a fixed end with said fixed end mounted to said planar base wherein said free end is positioned in spaced relation to said planar base thereby forming an opening there-between and with said semi-ring card-holding member being sufficiently rigid so that the free end remains off-set from said planar base while in use such that said semi-ring card-holding member remains open while in use, and a surface-mounting element mounting said base to a surface of said computer display device; and a plurality of rectangular cards having indicia printed thereon, wherein said plurality of cards are detachably mounted in tandem to said apparatuses.

8. A system comprising: a computer display device having a screen and a front surface surrounding the screen;

a display card having printed indicia thereon; and a mounting apparatus detachably mounting said card to said computer display device wherein said card is rotatable along an axis parallel with an outer edge of said front surface from a first position wherein said card lies parallel with and against said front surface of said computer display device with said card not obscuring any significant portion of said screen and with at least a portion of said printed indicia facing outwardly for viewing and a second position wherein said card does not lie parallel with nor against said front surface but extends away from said front surface, also not obscuring any significant portion of said screen; and wherein said mounting apparatus includes a planar base, a semi-ring card-holding member having a free end and a fixed end with said fixed end mounted to said planar base, and a surface-mounting element for mounting said planar base to a surface of said computer display device.

9. The system of claim 8 wherein said mounting apparatus has a free end and said free end and said planar base are positioned in spaced relation from one another thereby forming an opening there-between for receiving said display card.

10. The system of claim 8 having first and second of said mounting apparatuses.

11. The system of claim 8 wherein an outermost end of said free end of said semi-ring card-holding member is offset from an inner end of said planar base leaving a linear slot there between for passage of an outer edge portion of the card as said free end is passed through an aperture of the card.

12. The system of claim 8 wherein said free end of said semi-ring card-holding member extends partially past an outer end of said planar base.

13. The system of claim 8 wherein said surface mounting element is an adhesive strip.

* * * * *